United States Patent [19]

Palmaer

[11] 4,142,344

[45] Mar. 6, 1979

[54] METHOD OF PROVIDING A MOISTURE-PROOF OR MOISTURE-RESISTANT FOUNDATION INSULATION FOR BUILDINGS

[76] Inventor: Tore G. Palmaer, Smultronvägen 28, S-331 00 Varnamo, Sweden

[21] Appl. No.: 771,378

[22] Filed: Feb. 23, 1977

[30] Foreign Application Priority Data

Feb. 27, 1976 [SE] Sweden ..... 7602890

[51] Int. Cl.[2] ..... E04G 23/00; E04B 1/35

[52] U.S. Cl. ..... 52/742; 52/169.5; 52/169.11; 52/169.14

[58] Field of Search ..... 52/388, 169.14, 384, 52/169.1, 274, 742, 631, 169.5, 309.8, 309.16, 309.7, 169.11; 61/11, 13, 7, 38

[56] References Cited

U.S. PATENT DOCUMENTS

| | | | |
|---|---|---|---|
| 720,941 | 2/1903 | Mack | 52/384 X |
| 1,173,678 | 2/1916 | Munro | 52/384 |
| 2,050,798 | 8/1936 | Kothe | 52/169.14 |
| 2,420,734 | 5/1947 | Churchill | 252/134 |
| 2,534,137 | 12/1950 | Lewis | 428/169 |
| 2,954,635 | 10/1960 | Stotter | 45/68.3 |
| 3,077,059 | 2/1963 | Stout | 52/388 |
| 3,117,902 | 1/1964 | Holzheimer | 428/167 |
| 3,425,889 | 2/1969 | Willits, Jr. | 52/631 |
| 3,455,076 | 7/1969 | Clarvoe | 52/309.8 |
| 3,557,840 | 1/1971 | Maybee | 52/631 |
| 3,654,765 | 4/1972 | Healy et al. | 52/169.5 |
| 3,754,362 | 8/1973 | Damler et al. | 52/169.14 |
| 3,832,263 | 8/1974 | Cleveland et al. | 428/12 X |
| 3,958,385 | 5/1976 | Bondra, Jr. et al. | 52/631 |
| 4,015,432 | 4/1977 | Bell | 52/169.5 |

FOREIGN PATENT DOCUMENTS

| | | | |
|---|---|---|---|
| 970582 | 7/1975 | Canada | 52/169.11 |
| 1141067 | 12/1962 | Fed. Rep. of Germany | 52/384 |
| 1964769 | 9/1970 | Fed. Rep. of Germany | 52/169.14 |
| 2263896 | 7/1974 | Fed. Rep. of Germany | 52/169.5 |
| 613402 | 12/1960 | Italy | 52/169.5 |
| 7007626 | 5/1971 | Netherlands | 61/38 |

OTHER PUBLICATIONS

Perimeter Heating Receiving Rapid Acceptance, 2 pages, Jun. 1950, Bulletin of National Warm Air Heating and A/C Asso.

American Builder, Apr. 1963, pp. 60, 61, "Dry Basement".

*Primary Examiner*—Leslie Braun

[57] ABSTRACT

A method of providing a moisture proof or moisture resistant foundation insulation for buildings involves digging a narrow ditch around the building, providing an insulating foil in the ditch, providing drainage material in the bottom of the ditch and refilling the ditch. Preferred foils are of plastics material with an expanded layer on at least one side.

2 Claims, 5 Drawing Figures

METHOD OF PROVIDING A MOISTURE-PROOF OR MOISTURE-RESISTANT FOUNDATION INSULATION FOR BUILDINGS

The present invention relates to a method of providing a moisture-proof or moisture-resistant foundation insulation for buildings and to insulation material for use in the method.

In the construction of buildings with basement foundations, pressure bearings are provided at a frostproof depth at the same time as a relatively deeply laid subsoil water drainage system is laid. Basement space is provided which will be useful to some extent if sufficient heat insulation from adjacent ground is provided.

Constructions without basements use a so-called base-slab of which the edges are utilized as a bearing for the building and accordingly dimensioned. In order to avoid an ingress of frost underneath the slab, an insulation layer is applied immediately under the ground surface, just above the subsoil water drainage, said layer extending for 0.5 to 1 meter from the building.

However, there is a considerable heat transfer from the building above ground by reason of passing air and rain water, and under ground by reason of ground water. Accordingly, if it were possible to prevent subsoil water from coming near the bottom face of the house or the base-slab, it would be possible in a simple manner to reduce the need for ground insulation under the floor, which will be costly in one-storey buildings, and moreover, the ground under the house from about one meter above the foundation insulation level could be dried-out and form a mass acing somewhat as a heat sink for example between winter and summer.

It is understood that these difficulties could be solved by digging down to a sufficient depth and casting water-impermeable, vertical concrete walls. Such a method is, however, very costly and accordingly impractical.

In one aspect the present invention provides a method of providing a moisture proof or moisture resistant foundation insulation for buildings, wherein a narrow ditch is dug around the body of the building, an insulating foil is provided to extend down in the ditch, drainage material is provided in the bottom of the ditch and the ditch is filled in.

In another aspect the invention provides a foil for use in providing a moisture proof or moisture resistant foundation insulation for buildings and consisting of a moisture proof or moisture resistant sheet with an expanded layer on at least one face.

Because only a narrow ditch is dug, and because it is not filled with concrete, the invention offers a simple and labour saving solution to the problem of providing a volume of ground beneath a building which is insulated from moisture.

In a preferred form the method of the invention involves applying the foil onto the surface of the ditch nearer the center body of the building; attaching the foil to the outer edge of the body of the building to form a water-insulating layer; filling in drainage material in the form of tubes and gravel into the bottom of the ditch, and finally refilling the ditch. Higher located drainage is also possible.

As a result, a ground zone beneath the building will be dry at all times, so that no frost heaving can arise beneath the edges of the foundations of the building, and the primary cause of heat transfer, with ground water, is eliminated. This gives a substantial thermal insulation of the floor while the dry ground forms a substantial heat stabilizing factor, which in case the body of the building includes a swimming pool or similar heat accumulating devices can absorb heat therefrom. An example of such heat accumulating devices is a hot water accumulator situated in the middle of the building, which can easily be supplied with heat from conventional heating apparatuses as well as wind or sun energy.

For carrying out the method according to the invention it is preferred to use a foundation insulation consisting of a moisture-proof or moisture-resistant foil being at least on one side thereof provided with a layer of expanded material. It is also preferred for the foil to have bar-like reinforcements, and as a result, the insulation can be delivered in the form of a rolled up mat.

The invention will be more clearly understood from the following description which is given by way of example only with reference to the accompanying drawings, in which.

Figure 1:
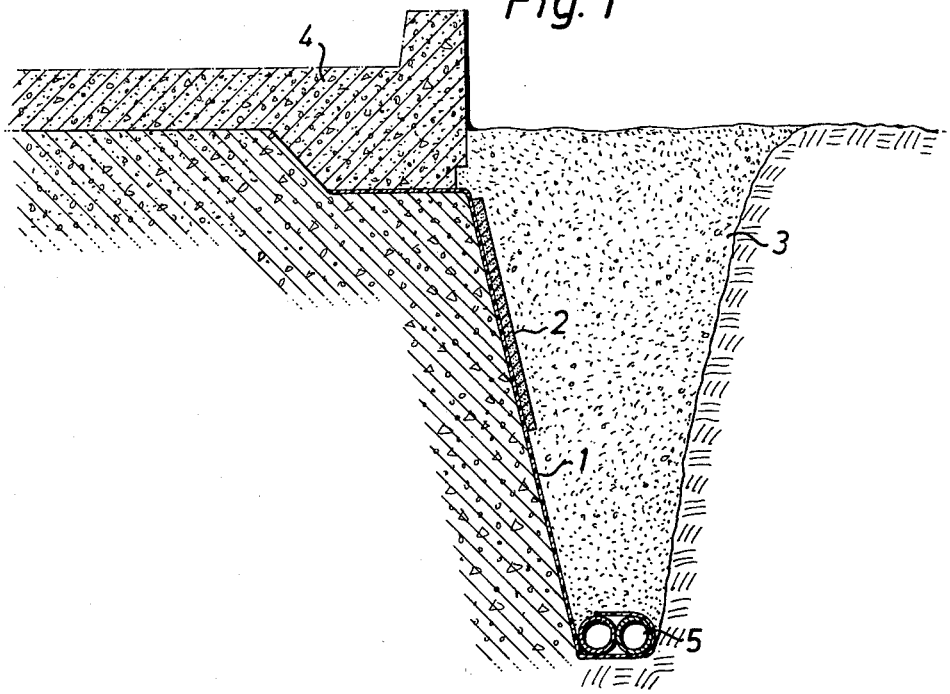
FIG. 1 shows a sectional view of a foundation insulation according to the invention.

In FIG. 1 are shown a foil 1 of, for instance, plastics, which is provided with spaced reinforcement bars 2 extending over its width. This is provided on one side of a ditch 3 surrounding the foundation 4 of the building. In the bottom of the ditch 3 drainage tubes 5 are provided.

The method proposed according to the invention involves first digging the ditch 3, for example to a depth of 2–2.5 meters, around the body of the building, and subsequently depositing the foil 1 into the ditch, making it extend substantially down to the bottom of the ditch 3, the reinforcement bars 2 provided on the foil extend down into the ditch at least one meter from the ground surface, the drainage tubes 5 are then placed into the bottom of the ditch 3 which is then refilled so that there is a minimum of manual labour.

Figure 2:
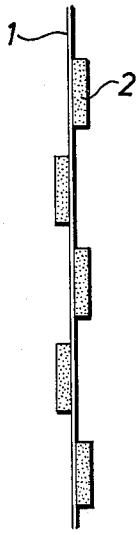
FIGS. 2 to 4 show three different embodiments of insulation material according to the invention.

In FIG. 2 a plastics foil 1 is shown, which is provided alternately on its sides with suitable reinforcement bars 2.

Figure 3:
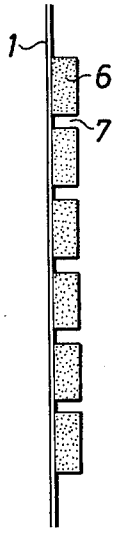
Figure 4:
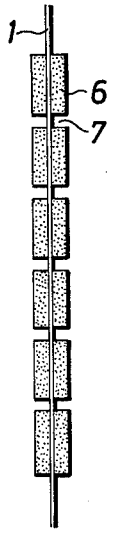
Figure 5:
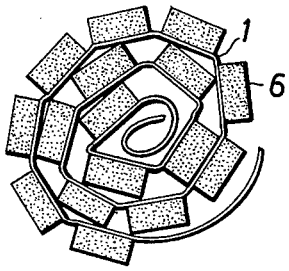
FIG. 5 shows a view of the insulation materail in a rolled-up condition.

FIGS. 3 and 4 show a plastics foil 1 one face (FIG. 3) or both faces (FIG. 4) of which is provided with a layer 6 of expanded elastic plastics material. This layer 6, which can be integral with the plastics foil, will suitably be shaped with spaces 7, so that the foil is capable of being rolled up. The layer can also have transverse spaces for the formation of a pattern divided in two directions. The expanded layer is easily achieved in a known manner and contains gas-filled pores, and forms, on one hand, a mechanical cover for the plastics foil giving protection against sharp stones or the like and on the other a thermal insulation. It is understood that in these embodiments vertical reinforcement bars can also be used, to give stability when laying the insulation, and to give a good hold in the foundation of the building.

As is seen from FIG. 1 the upper end of the foil can be attached to the foundation of the building, and it is also feasable to attach the lower end of the foil to the drainage material.

The reinforcement bars 2 shown in FIG. 2 can be arranged in different ways, crosswise to the longitudinal direction of the foil, on one face of the foil or both faces of the foil.

The foils proposed according to the invention can be joined in a simple and efficient manner at their respective end portions. Thus, a further advantage of the foundation insulation proposed according to the invention is the provision of a mat of a limited depth but of a great length, and which can be applied into the ditch in a simple manner concomitantly with the drainage material. The deposition can be made with an excavator having a sliding form, attention being necessary to the slide angle of the ditch.

It is to be understood that the invention is not limited to the embodiments shown in the drawing but can be modified in many ways witnin the scope of the appended claims.

I claim:

1. A method of moisture-proofing the lowermost floor of a building, comprising forming a relatively narrow ditch around and externally of the building and extending below the footing of said building, providing a water-proof rollable thermally insulating membrane having reinforcement means along its surface coextensive with the length of the building on the wall of said ditch closest to the building, attaching one longitudinal edge of said membrane to said building beneath the footing thereof and extending said membrane from the point of attachment with the building downwardly into the bottom of the ditch to cover said bottom, providing tile drainage material in the ditch on top of said membrane to cover the opposite longitudinal edge of said membrane and backfilling the ditch so as to create a region underlying the said lowermost floor and coextensive therewith substantially to the depth of said ditch which is insulated against the penetration of moisture.

2. The method according to claim 1 including the steps of forming such ditch at least meter deep and providing expanding plastic sections about the surface of said membrane between the longitudinal edges along the side of the ditch to provide thermal insulation.

* * * * *